United States Patent [19]

Okamoto

[11] Patent Number: 4,790,553

[45] Date of Patent: Dec. 13, 1988

[54] LIGHTWEIGHT WHEELCHAIR HAVING SWING-AWAY FOOTREST ASSEMBLY

[75] Inventor: James Okamoto, Clovis, Calif.

[73] Assignee: Motion Designs, Inc., Fresno, Calif.

[21] Appl. No.: 121,126

[22] Filed: Nov. 16, 1987

[51] Int. Cl.[4] ..... A47C 7/52; A61G 5/02

[52] U.S. Cl. ..... 280/242 WC; 280/42; 297/429

[58] Field of Search ..... 280/242 WC, 42, 657; 297/429, 433, DIG. 4

[56] References Cited

U.S. PATENT DOCUMENTS

| | | | |
|---|---|---|---|
| 2,485,016 | 10/1949 | Rideout | 297/45 |
| 2,601,379 | 6/1952 | Everest et al. | 280/47.39 |
| 2,866,495 | 12/1958 | Diehl et al. | 297/42 |
| 2,868,275 | 1/1959 | Mize | 297/429 |
| 3,205,007 | 9/1965 | Sommer | 297/429 |
| 4,164,354 | 8/1979 | Rodaway | 280/42 |
| 4,572,576 | 2/1986 | Minnebraker | 297/429 |
| 4,678,233 | 7/1987 | Chabrol et al. | 297/429 |
| 4,722,572 | 2/1988 | Sata | 297/433 |

*Primary Examiner*—John A. Pekar

*Attorney, Agent, or Firm*—Flehr, Hohbach, Test, Albritton & Herbert

[57] ABSTRACT

A lightweight wheelchair (10) including a front frame (27), footrest assembly (33), and mounting means (34,48) for mounting the footrest assembly (33) to the frame (27) for pivotal movement between a position in front of the chair and a position beside the chair is disclosed. The footrest assembly (33) is mounted to a front frame member (27) of the chair by a pivotal joint (34) and is further supported by a support bracket (48) which engages a side of the front frame member (27) below the pivotal joint (34). Mounted to the bracket (48) and front frame member (27) are cooperating subassemblies (56,57) which latch the footrest assembly (33) in a position in front of the chair and simultaneously bind or cam-down the inner end (49) of the bracket (48) against the side of the vertical front frame member (27). The latch assembly (52) can be operated by one of relatively limited manual dexterity, and the footrest assembly (33) can be removed from the wheelchair (10) by unlatching, rotating and lifting the footrest assembly (33). A mounting block (23) for securement of the seat frame (11) of the wheelchair (10) is also disclosed.

16 Claims, 3 Drawing Sheets

FIG _ 1
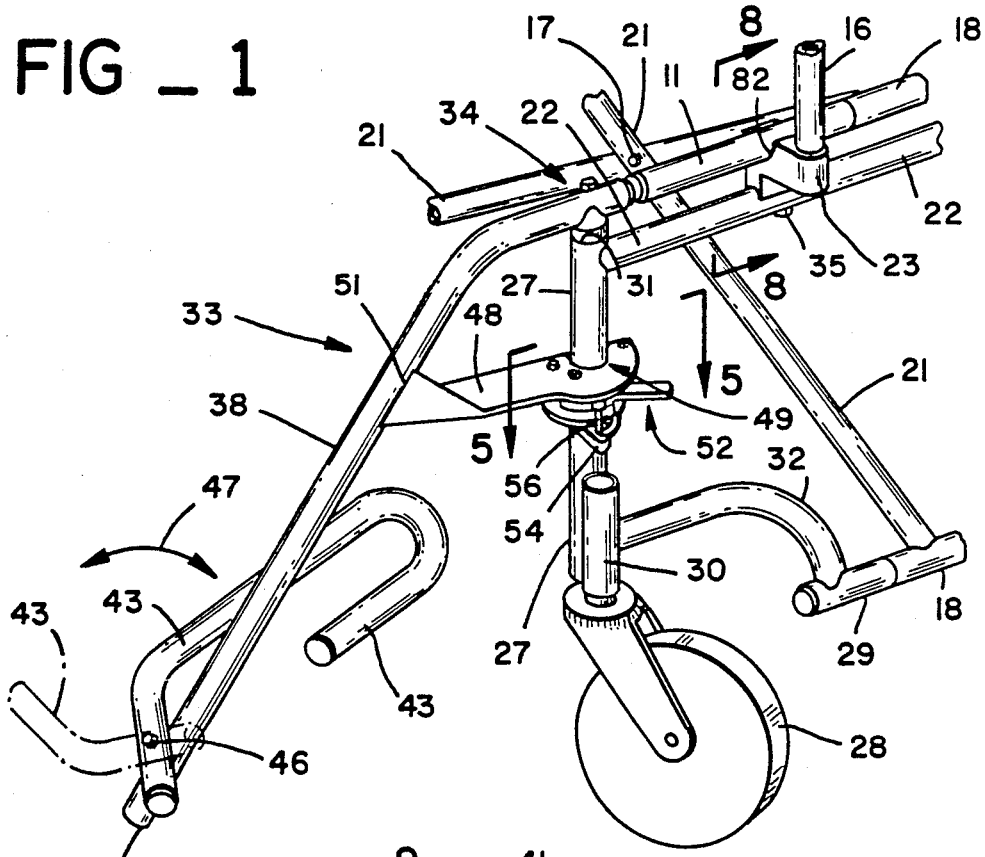
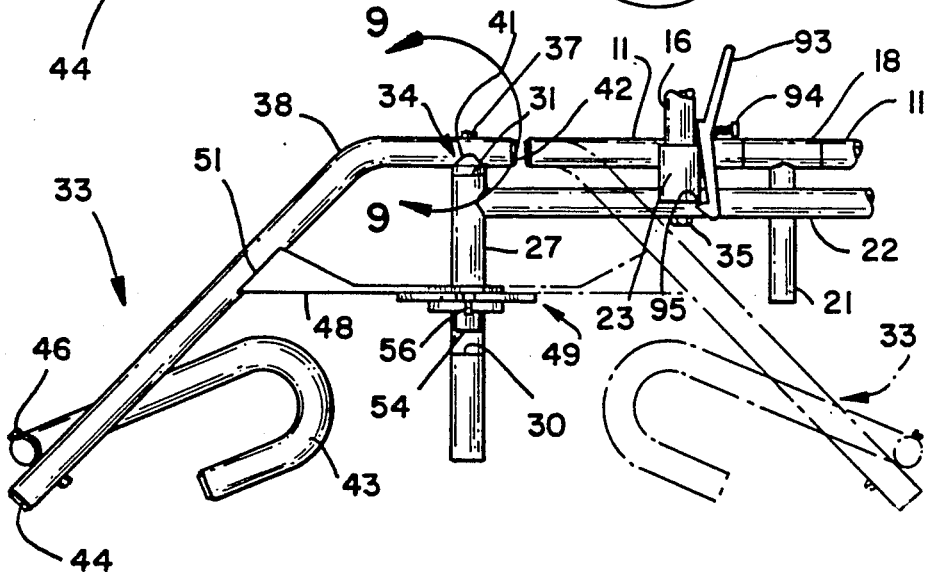
FIG _ 2

LIGHTWEIGHT WHEELCHAIR HAVING SWING-AWAY FOOTREST ASSEMBLY

TECHNICAL FIELD

This invention is in the field of wheelchairs which have swing-away footrest assemblies, and particularly lightweight wheelchairs which include such assemblies.

BACKGROUND ART

There has been a strong trend in recent years to attempt to make wheelchairs lighter in weight and more portable. Typically, such chairs may be folded to enable their easy transportation, and the wheelchair frames have been formed from tubular material, and most recently high-strength, lightweight, aircraft-grade aluminum tubing. Fabric seats and backrests are secured to the tubing, and the footrest assemblies which are provided typically are movably and/or detachably mounted to the wheelchair frame. Most usually, the footrest assemblies will pivot from a position in front of the chair to a position beside the chair where they will not interfere with the user's ability to get into and out of the wheelchair.

U.S. Pat. Nos. 2,485,016; 2,601,379 and 4,164,354 disclose foldable wheelchair assemblies which have movable footrest assemblies. In U.S. Pat. No. 2,485,016, the footrest can be moved from a horizontal to a vertical position aligned with one of the side frame assemblies. This allows the user to get in and out of the chair and enables folding of the chair to a relatively compact position. Unfortunately, the frame extensions for the footrest still protrude beyond the front of the chair and this portion of the frame is not detachable from the chair.

In U.S. Pat. No. 2,601,379, the footrest assemblies can be mounted to either of the front frame member or the back frame member. Thus, the footrest assemblies are detachable, but they are not swing-away assemblies.

U.S. Pat. No. 4,164,354 discloses a swing-away footrest assembly which is typical of the construction most frequently used in the industry. This footrest assembly employs a pair of pins which are carried by a mounting bracket that is welded to each of the tubular front frame members of the chair. A bifurcated footrest bracket having openings which receive the pins is mounted over the pins, with the footrest being gravity biased down over the pins for pivotal movement between a position in front of the chair and a position beside the chair.

The approach in U.S. Pat. No. 4,164,354 to providing swing-away footrest assemblies has several disadvantages. First, welding of pin carrying mounting brackets to the front tubular members can be accomplished if the front frame members are made of steel. When high-strength aluminum tubing is used in order to lighten chair weight, however, such welding will reduce the strength of the tubing by about one half. The use of steel front frame members to provide sufficient strength to enable welding results in an increase in a chair weight of at least about five pounds. Second, quadriplegics having limited manual dexterity have considerable problems in connection with aligning the two openings in the footrest bracket with the two pins on the chair frame. This task can be very tedious and difficult for a quadriplegic wheelchair user to perform. Third, such swing-away footrest assemblies often include a latching structure which will latch the footrest in the position in front of the chair which is also very difficult for a quadriplegic to operate. Thus, latching systems which employ one or more buttons that must be pressed in order to release the latch can be very difficult for users having limited manual dexterity.

Another problem which is encountered as the overall weight of a wheelchair decreases is the need to maintain sufficient rigidity in the chair so that the user feels secure in the chair. Thus, swingaway footrest assemblies must be capable of not only being latched in a position in front of the chair, but the assembly is most preferably relatively rigidly coupled to the frame in the latched position. The user may, therefore, support considerable lower body weight on the footrest without having a feeling that the rests will wobble with respect to the frame.

Another significant aspect of the manufacture of lightweight wheelchairs has been the need to reduce the number of components in the chair. Thus, the swing-away footrest assembly and latch assembly preferably should have a minimum number of parts so as to provide the advantages of a swing-away footrest without an undesirable increase in the overall complexity and cost of the chair.

DISCLOSURE OF THE INVENTION

The lightweight wheelchair assembly of the present invention includes a frame, a footrest assembly, and a mounting assembly having a pivotal joint mounting the footrest assembly to the frame for pivotal movement about a substantially vertically oriented axis between a position in front of the chair and a position beside the chair. In the improved wheelchair assembly of the present invention, the footrest assembly depends downwardly from the pivotal joint, a support bracket extends between the footrest and the frame and detachably engages a side of the frame below the pivotal joint. A latch assembly is positioned proximate the inner end of the support bracket for releasable latching of the footrest assembly in a position in front of the chair and for securement of the inner end of the support bracket tightly against the frame when latched in a position in front of the chair. The latch assembly includes a pivotally mounted lever that can be easily operated by a user with limited manual dexterity, and the latch assembly includes two cam surfaces which tightly bind and latch the inner end of the support bracket to the wheelchair frame. The latch assembly may be easily released and swung to a position beside the chair, at which position it also can be easily detached from the chair.

BRIEF DESCRIPTION OF THE DRAWING

FIG. 1 is a fragmentary top perspective view of one side of the frame of a lightweight wheelchair having a swing-away footrest assembly constructed in accordance with the present invention.

FIG. 2 is a fragmentary, side elevation view corresponding to FIG. 1 with the caster wheel not shown.

BEST MODE FOR CARRYING OUT THE INVENTION

Figure 3:
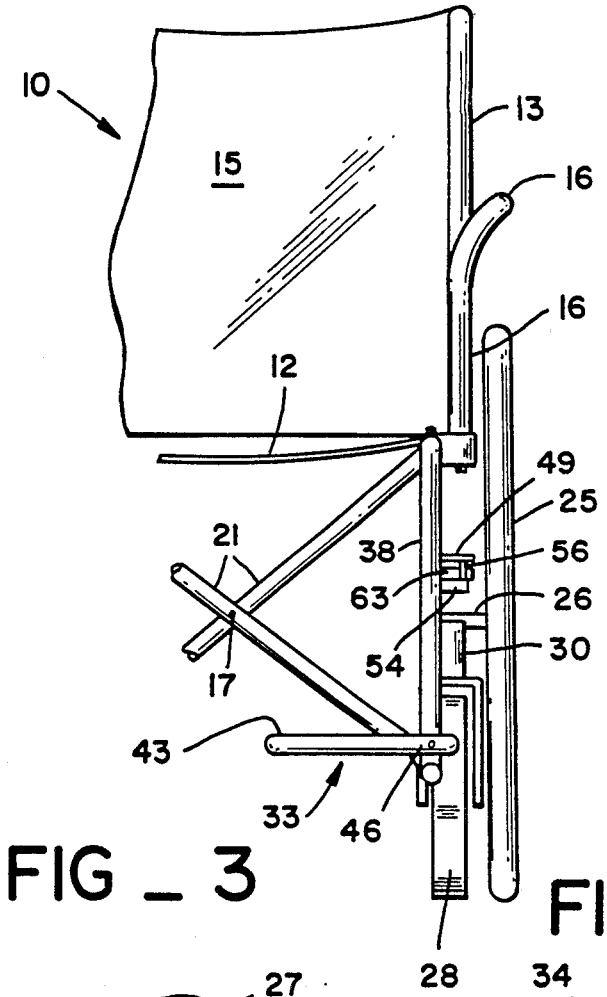
FIG. 3 is a fragmentary, front elevation view of the wheelchair of FIG. 1 in an open position.

The lightweight wheelchair of the present invention, generally designated 10, is preferably formed with a tubular aluminum frame including horizontally extending seat frame member 11 across which a flexible seat 12 is suspended. Seat 12 can be formed of a woven synthetic such as nylon or be formed from a canvas, leather or other suitable flexible sheet. The wheelchair frame also includes vertically oriented back frame members 13 having a seat back 15 distended therebetween and formed of a similar flexible sheet of material.

In order to provide additional portability, the wheelchair of the drawing is shown with a frame which is foldable. It will be understood, however, that the footrest assembly of the present invention can also be used on wheelchairs which do not have foldable frames. In the drawing, however, the wheelchair frame also includes a pair of cross braces 21 which are pivoted at 17 for movement between the positions shown in FIGS. 3 and 4. The ends 18 of braces 21 are similarly pivoted to horizontal side frame member 22 and to seat frame member 11. The ends 18 of cross braces 21 are formed as a length of hollow tube which pivots about a shaft carried by side frame member 29 and seat member 11. The opposite ends of braces 21 are provided with similar cylindrical end sections which are pivotally mounted to seat frame 11 and side frame 29 on the other side of the chair. This construction is broadly known in the industry and does not form a novel portion of the lightweight wheelchair of the present invention.

In order to both stabilize the seat frame 11 with respect to side frame member 22 and further to provide for support of an arm structure, the lightweight wheelchair of the present invention includes a mounting block 23 which is secured to frame member 22 by a bolt or fastener 31 in a manner which will be described in more detail hereinafter. Mounted to block 23 is a tubular arm frame member 16 which extends vertically up from block 23 and then longitudinally along the side of the chair and down into a second similarly formed block (not shown) mounted on side frame member 22.

Finally, the wheelchair frame includes a pair of substantially vertically oriented front frame members 27 which are secured to horizontal frame members 22 and 29, the latter being secured to front frame member 27 through the arcuate frame section 32 which accommodates front caster wheel 28. Mounted to front frame member 27 are the caster bearing housing 30 and the swing-away front frame assembly, generally designated 33, of the present invention. Also mounted between side frame members 22 and 29 are drive wheels 25 having axles 26 (FIGS. 3 and 4) that extend into a bearing assembly (not shown) coupled to the side frame members.

Figure 4:
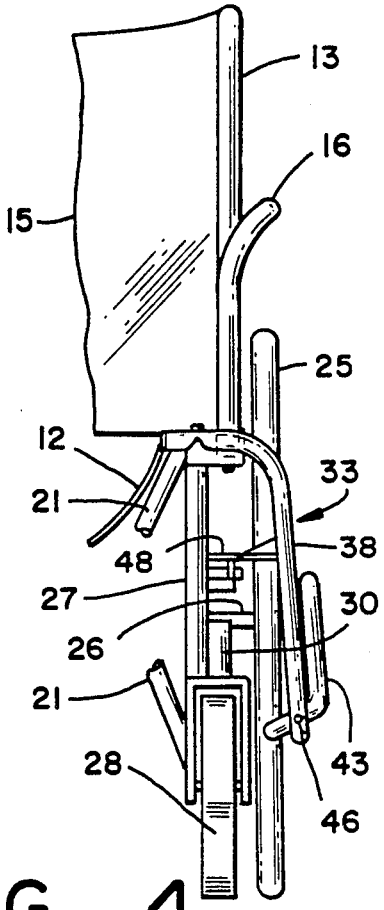
FIG. 4 is a similar view with the chair frame in a folded position.

In order to enable the user of the chair of the present invention to easily get into and out of the chair, footrest assembly 33 is pivotally mounted for movement about a substantially vertically oriented axis between a first position in front of the wheelchair (FIG. 1, solid lines in FIG. 2, and FIG. 3) and a second position beside the chair (FIG. 2 in phantom lines and FIG. 4). Such pivotally mounted, swing-away footrest assemblies are broadly known in the art, for example, the footrest assembly of U.S. Pat. No. 4,164,354.

Lightweight wheelchair 10 of the present invention, however, includes a footrest assembly which is mounted to the frame of the wheelchair in a way which does not require steel tubing or welding of components and yet can be easily operated and manipulated by users with relatively limited manual dexterity. Moreover, swing-away assembly 33 has a minimum number of components.

Figure 9:
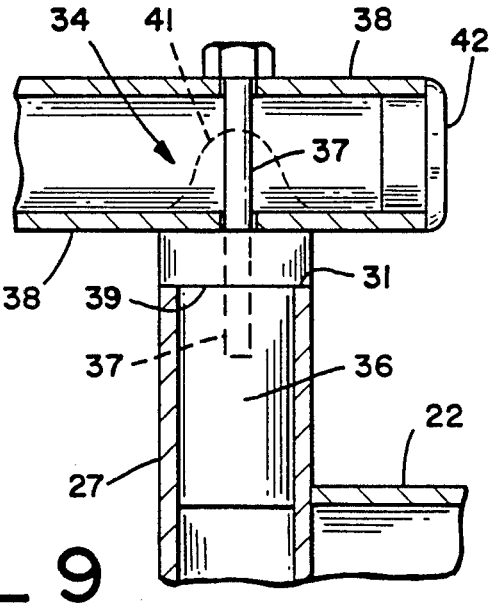
FIG. 9 is an enlarged, fragmentary, cross sectional view of the area bounded by line 9—9 in FIG. 2.

Mounting of the footrest assembly to the wheelchair frame is accomplished by providing a pivotal joint 34 at the upper end 31 of front frame member 27 and a support bracket means 48 below pivotal joint 34. The pivotal joint may best be seen in FIG. 9, and it is constructed in a manner which eliminates the need for welding of the aluminum frame members. A stub 36 is secured by fastener or bolt 37 to the upper end of footrest frame member 38. Stub 36 can be seen to have a bearing surface or shoulder 39 which seats on upwardly facing end or shoulder 31 of front frame member 27. The downwardly depending stub 36 is telescoped inside of front frame member 27 for pivotal movement with respect thereto. It is preferable that the pivotal stub 36 be formed of a material which has relatively low friction with respect to the aluminum tubing 27. Many plastics are suitable for this use. The stub 36 can include a yoke portion 41 which extends up around frame member 38 on both sides thereof to insure rotation of the stub with the frame member. Mounted in the end of frame member 38 is a cap 42 which closes the tubular footrest frame against entry of water or debris into the frame.

As thus constructed, pivotal joint 34 supports the load placed on the footrest assembly by axially loading member 27 through abutting surfaces 39 and 31 and by loading the end of member 37 in bending over the length of stub 36. This pivotal joint connection does not require welding of either front frame member 27 or footrest frame member 38 and yet can support a substantial load.

Footrest assembly 33 depends downwardly and outwardly from pivotal joint 34 and has a foot support member 43 mounted to distal end 44 thereof by a pivotal connection 46. As shown in FIG. 1, pivotal connection 46 allows member 43 to be moved between the solid line position in which it is closely adjacent and aligned with frame member 38 and the phantom line position for support of the user's foot, as indicated by arrows 47. Deployment of the foot support member 43 for use by the user of the chair is also shown in solid lines in FIG. 3.

While movement of foot support member 43 to a stored position as shown in solid lines of FIG. 1 provides the user with increased access to and from the chair, the downwardly and outwardly depending footrest frame 38 in front of the chair inhibits easy access from the side of seat 12. Accordingly, the pivotal joint 34 allows movement of frame element 38 to a position beside the chair, as shown in phantom in FIG. 2. This leaves the front and front-side of the seat more exposed to assist the user in getting in and out of the chair.

Footrest assembly 33 is subjected to considerably loading at various times. Accordingly, the pivotal joint 34 does not provide sufficient support on its own for some types of loads on the footrest assembly. In order to provide further support and to better stabilize the footrest assembly, therefore, the footrest assembly of the present invention includes a support bracket means 48 which extends from tubular member 38 to vertical frame member 27 at a position below joint 34. The support bracket includes an inner end, generally designated 49, which is formed to mate with and rotatably engage a side of frame member 27. Again, the inner end 49 of support bracket 48 is formed to support the weight of the footrest assembly without requiring welding of vertical tubular frame member 27. (Welding of outer end 51 of bracket 48 to footrest frame member 38 can be tolerated because the footrest frame member 38 does not experience the same degree of loading as does vertical frame member 27, which must support the load on the seat as well as the load on the footrest assembly.) Accordingly, the support bracket means 48 of the present invention is detachably coupled to front frame member 27 without the need for welding and loads the front frame member primarily in bending by bearing upon a side wall of member 27.

The footrest assembly of the present invention further includes a latch assembly, generally designated 52, positioned proximate inner end 49 and releasably latching the footrest assembly against pivotal movement in the first position in front of the chair. Latch assembly 52 further secures inner end 49 in tight abutting relation against a side of frame member 27 when the footrest assembly is in the first position to relatively rigidly support the footrest assembly from the wheelchair frame. It is particularly important in lightweight wheelchairs that moveable components can be latched in a position which feels rigid and secure to the user. Accordingly, the footrest assembly should not be loose or wobble, even though they are latched in a forward or first position.

Figure 7:
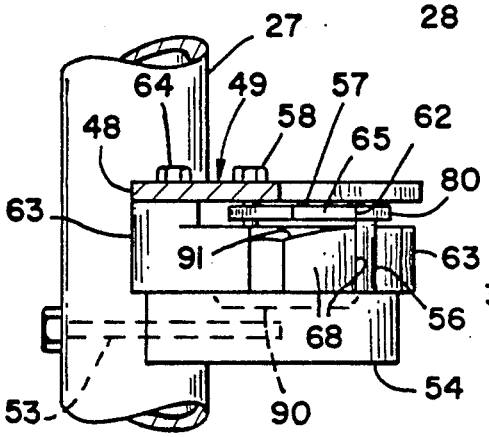
FIG. 7 is an enlarged, fragmentary, cross sectional view taken substantially along the plane of line 7—7 in FIG. 5.
Figure 5:
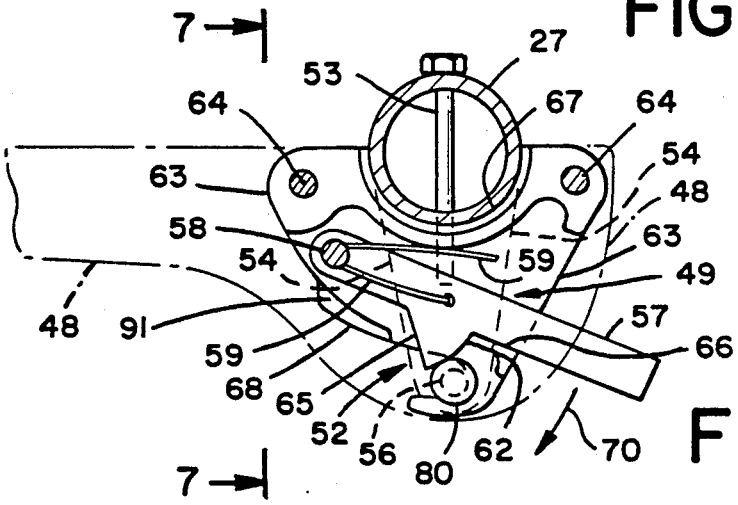
FIG. 5 is an enlarged, fragmentary, top plan view taken substantially along the plane of line 5—5 in FIG. 1, with the footrest bracket shown in phantom.
Figure 6:
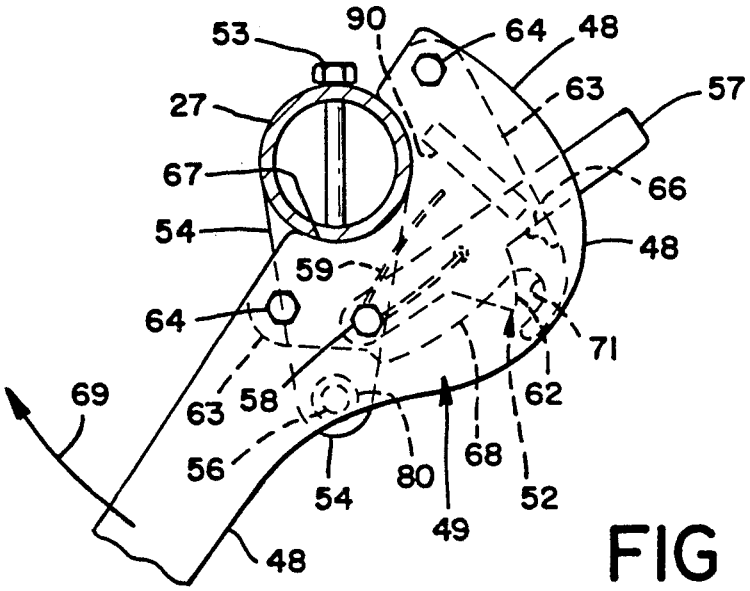
FIG. 6 is an enlarged, fragmentary top plan view corresponding to FIG. 5 with the footrest assembly in a moved position.

The details of construction of latch assembly 52 can best be understood by reference to FIGS. 5 and 6. Inner end 49 of support bracket 48 can be seen to have a generally C-shaped plan view. Mounted in axially spaced relation to end 49 is a member 63, which also has a C-shaped surface 67 that mates with the side of member 27. Together end 49 and member 63 slidably engage and pivot about the side of tubular front frame member 27. Secured to a side of front frame member 27 by bolt or fastener 53 is a mounting bracket 54 (best seen in FIGS. 6 and 7) which extends laterally of frame member 27 and carries a vertically extending latch pin 56 (also together referred to herein as a first interlock sub-assembly). Thus, latch pin 56 and tubular member 27 are in generally parallel spaced apart relation. Again, the securement of the first interlock sub-assembly to tubular member 27 is by means of a fastener and not by welding. Bracket 54 can be formed of a lightweight plastic or metal material, but it is preferable that latch pin 56 be provided as a steel pin having an enlarged head 80.

Carried by the inner end 49 of bracket 48 is a latching lever 57 which is pivotally mounted about pivot pin 58 and spring biased by torsion spring 59 for biasing of lever 57 in the direction indicated by arrow 70 (also referred to as the second interlock sub-assembly). Latching lever 57, therefore, is biased outwardly from member 27 toward engagement with latch pin 56 and an upwardly protruding stop 66 on member 63. It is further preferable that latching lever 57 include a latching shoulder 62 which engages head 80 of latch pin 56 and cooperates with the latch pin to prevent rotation of the inner end of the bracket when the bracket and footrest assembly have been rotated to the first position.

The inner end, including member 63, and latch assembly 52 are constructed so that the inner end also will be snubbed or bound up against front frame member 27 during the process of rotating bracket 48 from the second position alongside the chair to the first position in front of the chair. Member 63 is secured in vertically spaced relation to bracket inner end 49 by bolts 64. Surface 67 mates with tubular member 27 to increase the contact surface area and decrease the stress concentration between the inner end and tubular member 27. Member 63 further includes a cam surface 68 which has a radius (with respect to the axis of member 27) that increases as the surface extends in a counterclockwise direction as viewed in FIGS. 5 and 6. Thus, cam surface 68 tends to cause member 63 to wedge or bind between latch pin 56 and tubular member 27 as the bracket is rotated from the position of FIG. 6 to the position of FIG. 5, as indicated by arrow 69 in FIG. 6. Cam surface 68 terminates in a notch or recess 71 (FIG. 6) that receives latch pin 56. Member 63 preferably extends around to the other bolt or fastener 64.

Operation of the latch assembly 52 to both latch and progressively bind the inner end 49 of bracket 48 against frame member 27 now can be described. As bracket 48 is rotated in the direction of arrow 69, the front surface 65 of latching lever 57 will engage latch pin 56, and the lever will be displaced against biasing spring 59 in a direction opposed to arrow 70 to allow the lever to pass beyond pin 56. As rotation of bracket 48 is continued, cam surface 68 also begins to engage pin 56 and press or urge the inner end of the bracket (49 and 63) against frame member 27. As the bracket is rotated to the position of FIG. 5, spring 59 urges the lever in the direction of arrow 61 so that shoulder 62 on the latching lever snaps out and engages head 80 of pin 56 to resist movement of the assembly in a counterclockwise direction. Additionally, it is preferable to provide a downwardly depending stop shoulder 90 (FIGS. 6 and 7) on member 63 which will engage mounting bracket 54 when the assembly is rotated to the position of FIG. 5.

It is an important feature of the latch assembly of the present invention that surface 62 be formed as a cam surface so that urging of lever 57 in the direction of arrow 70 will force the latch pin and notch 71 into abutting engagement with each other. Thus, the latch assembly of the present invention has two cam surfaces which produce a very firm and relatively rigid coupling between the inner end 49 of the bracket and frame member 27. Cam surface 68 wedges member 63 and the inner end of the bracket between latch pin 56 and the tubular member, while cam surface 62 wedges the pin against notch 71.

Moreover and very importantly, this latching and combined camming action can be accomplished simply by rotating bracket 48 to the front position and urging the distal end of lever 57 in the direction of arrow 70. These tasks are relatively simple for even those users who have limited manual dexterity. There are no buttons to push or openings and pins to align.

Release of the latch assembly also is simply accomplished by rotating lever 57 in a direction opposed to arrow 70. This causes the shoulder 62 to be pivoted out of contact with latch pin 56 and enables the entire bracket to be rotated in a direction opposed to arrow 69 in FIG. 6.

An important feature of the latch assembly is that positioning of the lever and cam surface 68 between latch pin 56 and tube 27 tends to load the bolt 53 in tension. The load on the footrest assembly is transferred to front frame member 27 primarily transversely to the longitudinal axis of the front frame member, and the overall latch assembly 52 does not experience any significant vertical loading.

Detachment of the footrest assembly can also be easily accomplished. Latch pin 56 includes an enlarged head 80 which engages the top surface of member 63 above the portion of the latch pin which is engaged by camming surface 68. Member 63 advantageously includes a third cam surface 91 (FIGS. 5 and 7) which engages head 80 of the latch pin and lifts the head to a position resting on the surface above cam surface 68. When head 80 is engaged with member 63, the enlarged head prevents lifting of the latch assembly axially along member 27. Once the bracket is pivoted to the position of FIG. 6, however, surface 68 can be seen to be clear of enlarged head 80, and the entire footrest assembly 33 can be lifted vertically. Stub 36 will lift out of tube upper end 31 and inner end 49 of the bracket, which carries member 63, will lift up past the latch pin head 80, which no longer engages member 63. Again, this only requires release of the latch by lever 57, rotation of bracket 48 towards the second position and lifting of the entire footrest assembly, all tasks which require limited manual dexterity. Thus, the latch assembly is formed for tool-free detachment from the wheelchair frame once it has been rotated to a position beside the frame.

Figure 8A:
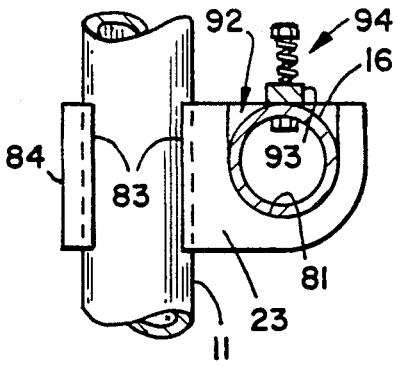
FIG. 8A is a top plan fragmentary view taken substantially along the plane of line 8A—8A in FIG. 8.
Figure 8:
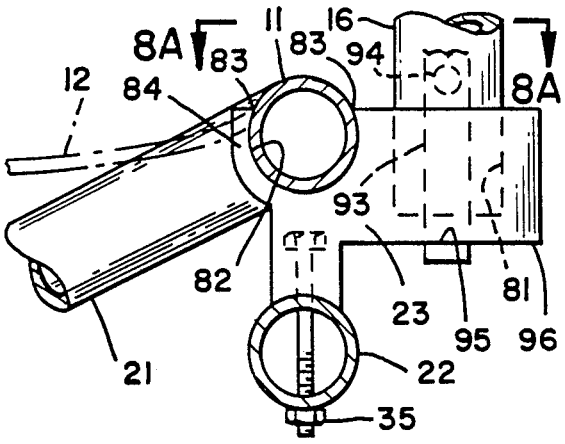
FIG. 8 is an enlarged, fragmentary, cross sectional view taken substantially along the plane of line 8—8 in FIG. 1.

As briefly described above, the wheelchair frame structure of the present invention preferably includes a frame mounting block 23 which is employed to provide a mount for armrest 16 as well as to secure the folding seat frame member 11 in the deployed position of FIG. 8. Block 23 preferably includes a U-shaped socket 81 dimensioned to receive armrest post 16 from an open side thereof. As will be seen in FIG. 8A, socket 81 has a side mouth 92 which allows armrest 16 to be pivoted up out of the socket about a pivot pin (not shown) proximate the back frame.

Most preferably armrest member 23 carries a latch member 93 pivoted about bolt and spring assembly 94. The lower end of latch 93 includes a shoulder 95 which engages the downwardly facing surface 96 on block 23 to latch the armrest to block 93.

Block 23 also includes a horizontally oriented cylindrical recess 82 having an open side defined by edges 83 formed to receive tubular frame member 11. The cylindrical recess is formed so that the circumference extends slightly beyond 180 degrees to provide a resilient detent which grabs or detains frame member 11. Thus, the block 23 may be formed of a resilient plastic material so that section 84 will be laterally displaced upon urging of frame member 11 downwardly into recess 82. As the diameter of frame member 11 passes beyond the edges 83 of the opening, the resilient block material will snap back and urge the frame member down into the recess where it is secured against upward displacement.

The weight of the user on sling seat 12 has tended to lift frame member 11 up off of prior art support brackets commonly positioned under member 11. Thus, such supports have generally been ineffective. Moreover, as a wheelchair passes over bumps and the like, there has been a tendency for foldable chairs to collapse or fold up when seat 12 becomes unweighted. While total collapse of the chairs would not be possible, the sensation of folding of the seat frames under dynamic conditions is quite unsettling to the user as well as potentially fatiguing to the frame.

The mounting block 23 of the present invention minimizes these problems. Moreover, block 23 greatly increases the rigidity of the wheelchair frame assembly by positively gripping the seat frame members 11, and block 23 also affords a connection between highly stressed frame members which does not require welding.

What is claimed is:

1. A lightweight wheelchair including a frame including a tubular front frame member, a footrest assembly, and mounting means including a pivotal joint mounting said footrest assembly to said frame member for pivotal movement about a substantially vertically oriented axis between a first position in front of said wheelchair and a second position beside said wheelchair, wherein the improvement in said wheelchair assembly comprises:

said footrest assembly depending downwardly and outwardly from said pivotal joint;

support bracket means extending between said footrest assembly and said frame below said pivotal joint, said support bracket means including an inner end mating with and rotatably engaging a side of said frame member and supporting said footrest assembly from said frame member during said pivotal movement; and a latch assembly positioned proximate said inner end and releasably latching said footrest assembly against pivotal movement in said first position and securing said inner end tightly against said frame member in said first position to relatively rigidly support said footrest assembly from said frame.

2. A lightweight wheelchair as defined in claim 1 wherein, said frame member is oriented in a substantially vertical orientation and terminates in an upwardly facing open end;

said pivotal joint is provided by a downwardly depending stub carried by said footrest assembly and mounted in telescoped relation inside said open end; and said inner end of said support bracket means is formed with a C-shaped recess mating with and detachable from a side of said frame member below said open end.

3. A lightweight wheelchair as defined in claim 1 wherein, said latch assembly includes a latching lever mounted to one of said inner end and said frame member, a latch pin mounted to the other of said inner end and said frame member and spring biasing means biasing said lever into latching engagement with said latch pin in said first position; and said inner end is detachable from said frame by manipulation of said footrest assembly.

4. A lightweight wheelchair as defined in claim 3 wherein, said latching assembly includes a cam surface formed to urge said inner end into tight abutting relation with said side of said frame member as said footrest assembly is pivoted from said second position to said first position.

5. A lightweight wheelchair as defined in claim 3 wherein, said frame member is substantially vertically oriented;

said pivotal joint couples said footrest assembly to said frame member;

said latch assembly includes a mounting bracket secured to said frame member having said latch pin carried thereby, said latch pin being oriented in a generally parallel spaced apart relation to said frame member;

said latch assembly further includes a latching lever pivotally carried by said inner end and spring biased toward engagement with said latch pin, said lever including a latching shoulder cooperating with said latch pin to prevent rotation of said inner end toward said second position once said inner end has been rotated to said first position; and said inner end including a cam surface formed to progressively engage said latch pin upon rotation of said inner end from said second position to said first position to bind said inner end between said latch pin and said frame member in said first position.

6. A lightweight wheelchair as defined in claim 5 wherein, said latch assembly includes a notch receiving said latch pin when said inner end is in said first position; and said latching shoulder includes a cam surface urging said inner end to rotate about said frame member until said notch is abutting against said latch pin.

7. A lightweight wheelchair as defined in claim 1 wherein, said latch assembly includes a pivotally mounted latching lever having a distal end positioned for manual engagement and pivoting of said lever to release said latch assembly.

8. A lightweight wheelchair as defined in claim 1 wherein, said pivotal joint and said latch assembly are formed for tool-free detachment from said frame when in said second position by manipulation of said footrest assembly.

9. A lightweight wheelchair including a frame having a front frame member, a footrest assembly, mounting means mounting said footrest assembly to said front frame member for movement between a first position in front of said wheelchair and a second position beside said wheelchair, and a latch assembly releasably latching said footrest assembly in said first position, wherein the improvement in said wheelchair comprises:

said latch assembly including a latch pin, a pivoted lever mounted to engage said latch pin in said first position, and spring biasing means mount to bias said lever to a position preventing movement of said footrest assembly from said first position to said second position, said lever having a manually engageable distal end and said lever being pivotable by said end in one direction to latch said latch assembly and pivotable in an opposite direction against said spring biasing means release said latch assembly, said latch pin being mounted to said frame member in spaced generally parallel relation thereto and said lever being carried by said mounting means for movement with said footrest assembly.

10. A lightweight wheelchair as defined in claim 9 wherein, said lever is mounted between said latch pin and said frame member.

11. A lightweight wheelchair as defined in claim 10 wherein, said latch assembly includes a first cam surface formed to progressively urge said mounting means into engagement with said frame member as said footrest assembly is moved from said second position to said first position.

12. A lightweight wheelchair as defined in claim 10 wherein, said lever includes a latching shoulder positioned to engage said latch pin, and said shoulder has a cam surface thereon formed to urge said mounting means against said latch pin for binding of said latch pin between said shoulder and said mounting means.

13. A lightweight wheelchair as defined in claim 10 wherein, said mounting means mounts said footrest assembly for pivotal movement about said frame member;

said mounting means includes a support bracket having a C-shaped inner end dimensioned for mating engagement with said pivoting around said front frame member;

said lever is carried by said inner end and is positioned between said latch pin and said frame member;

said inner end further carries a first cam surface oriented to progressively engage and wedge said inner end between said latch pin and said frame member as said inner end is pivoted to said first position;

said lever includes a latching shoulder having a second cam surface engaging said latch pin when said inner end is pivoted to said first position, said second cam surface further urging said inner end into engagement with said latch pin as said lever is pivoted in a direction locking said inner end to said latch pin; and said latch assembly is formed to limit relative displacement of said latching shoulder along said latch pin in said first position.

14. A lightweight wheelchair having a foldable frame including a side frame assembly and a seat frame foldable between a collapsed position and deployed position, said seat frame assembly including a seat frame member positioned in superimposed relation above a side frame member when said seat frame assembly is in said deployed position, a frame mounting block secured to one of said side frame member and said seat frame member and having a recess receiving the other of said side frame member and said seat frame member when said seat frame assembly is in said deployed position, wherein the improvement in said wheelchair comprises:

said mounting block further including resiliently displaceable detent means proximate said recess engaging and releasably detaining said seat frame assembly in said deployed position.

15. The wheelchair of claim 14 wherein, said mounting block is formed of a resilient material mounted to said frame member;

said resiliently displaceable detent means is provided by an open-sided cylindrical recess having a circumference slightly more than 180 degrees whereby said seat frame is resiliently detained by said portions of said mounting block defining said cylindrical recess when said seat frame is in said recess.

16. A lightweight wheelchair having a footrest assembly movable between a first position in front of said wheelchair and a second position beside said wheelchair, said wheelchair having a side frame assembly including a substantially vertical front frame member; and said footrest assembly including a footrest frame pivotally mounted to said front frame member for movement between said first position and said second position, a first interlock sub-assembly mounted on said wheelchair side frame assembly, a second interlock sub-assembly mounted on said footrest frame, said first interlock sub-assembly and said second interlock subassembly cooperatively positioned and interengaging each other when said footrest assembly is in said first position to lock said footrest assembly against movement from said first position, and one of said first interlock sub-assembly and said second interlock sub-assembly being formed for selective unlocking of said footrest assembly to release said footrest assembly for movement to said second position, wherein the improvement in said wheelchair comprises:

said footrest frame being mounted for pivotal movement about an axis concentric with said front frame member;

said first interlock sub-assembly being mounted to said vertical frame member; and said second interlock sub-assembly being formed to slidably and rotatably engage a side of said vertical frame member proximate said first interlock sub-assembly to support and guide said footrest assembly during movement of said footrest assembly between said first position and said second position.

* * * * *

REEXAMINATION CERTIFICATE (1396th)

United States Patent [19] [11] B1 4,790,553

Okamoto [45] Certificate Issued Dec. 25, 1990

[54] LIGHTWEIGHT WHEELCHAIR HAVING SWING-AWAY FOOTREST ASSEMBLY

[75] Inventor: James Okamoto, Clovis, Calif.

[73] Assignee: Motion Designs, Inc., Fresno, Calif.

Reexamination Request:
No. 90/001,862, Oct. 11, 1989

Reexamination Certificate for:

| | |
|---|---|
| Patent No.: | **4,790,553** |
| Issued: | **Dec. 13, 1988** |
| Appl. No.: | **121,126** |
| Filed: | **Nov. 16, 1987** |

[51] Int. Cl.[5] ..... A47C 7/52; A61G 5/02

[52] U.S. Cl. ..... 280/250; 280/42; 297/429

[58] Field of Search ..... 280/304.1, 250.1; 297/429, 433

[56] References Cited

U.S. PATENT DOCUMENTS

| | | | |
|---|---|---|---|
| 2,485,016 | 10/1949 | Rideout | 280/250.4 |
| 2,601,379 | 6/1952 | Everest et al. | 280/250.4 |
| 2,866,495 | 12/1958 | Diehl et al. | 280/250.4 |
| 2,886,275 | 1/1959 | Mize | 280/250.4 |
| 3,205,007 | 9/1965 | Sommer | 280/304.1 |
| 3,857,606 | 12/1974 | Rodaway | 280/250.4 |
| 4,164,354 | 8/1979 | Rodaway | 280/250.4 |
| 4,572,576 | 2/1986 | Minnebraker | 280/250.4 |
| 4,678,233 | 7/1987 | Chabrol et al. | 297/429 |
| 4,722,572 | 2/1988 | Sata | 280/250.4 |
| 4,770,476 | 9/1988 | Zinn | 280/250.4 |
| 4,790,553 | 12/1988 | Okamoto | 280/250.1 |

FOREIGN PATENT DOCUMENTS

| | | | |
|---|---|---|---|
| 1344688 | 1/1974 | United Kingdom | 280/250.4 |

*Primary Examiner*—David M. Mitchell

[57] ABSTRACT

A lightweight wheelchair (10) including a front frame (27), footrest assembly (33), and mounting means (34,48) for mounting the footrest assembly (33) to the frame (27) for pivotal movement between a position in front of the chair and a position beside the chair is disclosed. The footrest assembly (33) is mounted to a front frame member (27) of the chair by a pivotal joint (34) and is further supported by a support bracket (48) which engages a side of the front frame member (27) below the pivotal joint (34). Mounted to the bracket (48) and front frame member (27) are cooperating subassemblies (56,57) which latch the footrest assembly (33) in a position in front of the chair and simultaneously bind or cam-down the inner end (49) of the bracket (48) against the side of the vertical front frame member (27). The latch assembly (52) can be operated by one of relatively limited manual dexterity, and the footrest assembly (33) can be removed from the wheelchair (10) by unlatching, rotating and lifting the footrest assembly (33). A mounting block (23) for securement of the seat frame (11) of the wheelchair (10) is also disclosed.

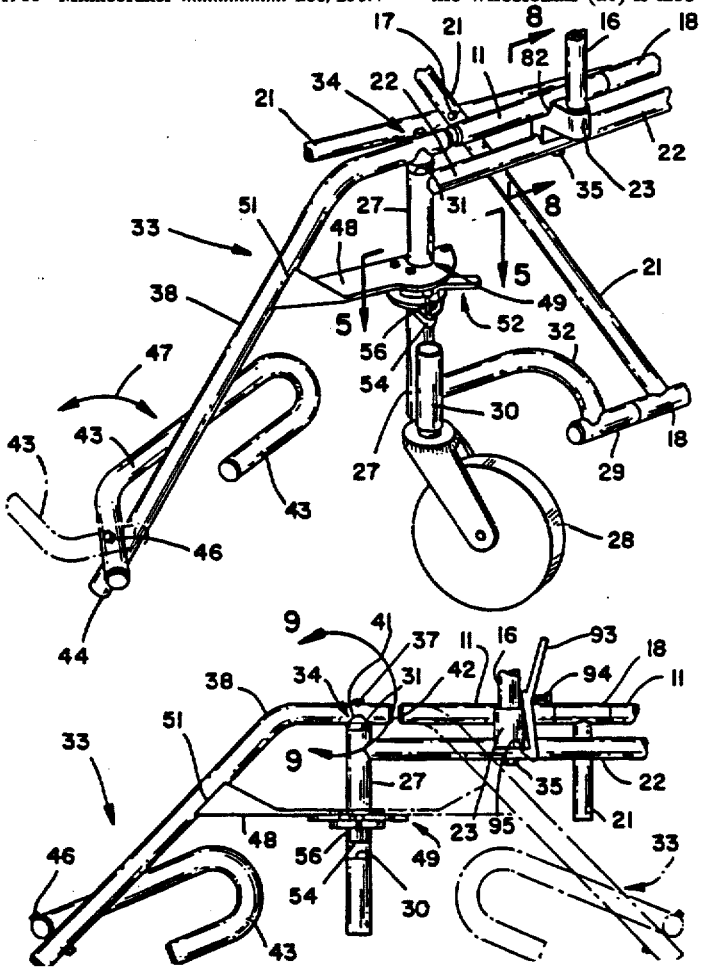

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 9–15 is confirmed.

Claims 1, 2, 3, 7, 8 and 16 are determined to be patentable as amended.

Claims 4–6, dependent on an amended claim, are determined to be patentable.

New claims 17 and 18 are added and determined to be patentable.

1. A lightweight wheelchair including a frame including a tubular front frame member, a footrest assembly, and mounting means including a pivotal joint mounting said footrest assembly to said frame member for pivotal movement about a substantially vertically oriented axis between a first position in front of said wheelchair and a second position beside said wheelchair, wherein the improvement in said wheelchair assembly comprises:

said footrest assembly depending downwardly and outwardly from said pivotal joint;

support bracket means extending between said footrest assembly and said frame below said pivotal joint, said support bracket means including an inner end mating with and rotatably engaging a side of said frame member and supporting said footrest assembly from said frame member during said pivotal movement; and a latch assembly positioned proximate said inner end and *having a latch element positioned in radially spaced relation to an exterior surface of said front frame member, and a manually displaceable latching member mounted by mounting means to one of said inner end and said front frame member for guided movement between a latched position engaging said latch element and an unlatched position out of contact with said latch element, said latch assembly* releasably latching said [footrest assembly] *inner end to said front frame member* against pivotal movement *of said footrest assembly* in said first position, and *said latch assembly* securing said inner end [tightly] *in tight abutting relation* against said frame member in said first position to relatively rigidly support said footrest assembly from said frame.

2. A lightweight wheelchair as defined in claim 1 wherein, said frame member is oriented in a substantially vertical orientation and terminates in an upwardly facing open end;

said pivotal joint is provided by a downwardly depending stub carried by said footrest assembly and mounted in telescoped relation inside said open end; and said inner end of said support bracket means is formed with a C-shaped recess mating with and detachable from a side of said frame member below said open end[.] *; and*

*said latch assembly includes a latch pin mounted in generally parallel relation to said front frame member on one of said inner end and said front frame member, and a latching lever mounted to the remainder of said inner end and said front frame member for latching engagement with said latching pin.*

3. A lightweight wheelchair as defined in claim 1 wherein, said [latch assembly includes] *latching member is provided by* a latching lever mounted to one of said inner end and said frame member, *and said latch element is provided by a* a latchpin mounted to the other of said inner end and said frame member and spring biasing means biasing said lever into latching engagement with said latch pin in said first position; and said inner end is detachable from said frame by manipulation of said footrest assembly.

7. A lightweight wheelchair as defined in claim 1 wherein, said [latch assembly includes] *latching member is provided by* a pivotally mounted latching lever having a distal end positioned for manual engagement and pivoting of said lever to release said latch assembly.

8. A lightweight wheelchair as defined in claim 1 wherein,

*said front frame member terminates in an upper end,*

*said pivotal joint telescopically mounts said footrest assembly to said upper end for unimpeded lifting of said pivotal joint from said upper end, and* said [pivotal joint and said] latch assembly [are] *is* formed *for substantially unimpeded lifting of said footrest assembly from said frame* for [tool-free] detachament *of said footrest assembly* from said frame when *said footrest assembly is* in said second position by manipulation of said footrest assembly.

16. A lightweight wheelchair having a footrest assembly movable between a first position in front of said wheelchair and a second position beside said wheelchair, said wheelchair having a side frame assembly including a substantially vertical front frame member; and said footrest assembly including a footrest frame pivotally mounted to said front frame member for movement between said first position and said second position, a first interlock sub-assembly mounted on said wheelchair side frame assembly, a second interlock sub-assembly mounted on said footrest frame, said first interlock sub-assembly and said second interlock subassembly cooperatively positioned and interengaging each other when said footrest assembly is in said first position to lock said footrest assembly against movement from said first position, and one of said first interlock sub-assembly and said second interlock sub-assembly being formed for selective unlocking of said footrest assembly to release said footrest assembly for movement to said second position, wherein the improvement in said wheelchair comprises:

said footrest frame being mounted for pivotal movement about an axis concentric with said front frame member;

said first interlock sub-assembly being mounted to said vertical frame member *and including a latch pin oriented generally parallel to said front frame member*; and said second interlock sub-assembly *including a movable lever latching against said latch pin, and said second interlock sub-assembly* being formed to slidably and rotatably engage a side of said vertical frame member proximate said first interlock sub-assembly to support and guide said footrest assembly during movement of said footrest assembly between said first position and said second position.

*17. A lightweight wheelchair including a frame including a tubular front frame member, a footrest assembly, and mounting means including a pivotal joint mounting said footrest assembly to said frame member for pivotal movement about a substantially vertically oriented axis between a first position in front of said wheelchair and a second position beside said wheelchair, wherein the improvement in said wheelchair assembly comprises:* said footrest assembly depending downwardly and outwardly from said pivotal joint;

*support bracket means extending between said footrest assembly and said frame below said pivotal joint, said support bracket means including an inner end mating with and rotatably engaging a side of said frame member and supporting said footrest assembly from said frame member during said pivotal movement; and*

*a latch assembly positioned proximate said inner end and having a manually displaceable, pivotally mounted latching lever releasably latching against a latch element positioned in spaced relation to an exterior surface of said front frame member to latch said inner end to said front frame member against pivotal movement of said footrest assembly in said first position, and said latch assembly securing said inner end in tight abutting relation against said frame member in said first position to relatively rigidly support said footrest assembly from said frame.*

*18. A lightweight wheelchair as defined in claim 1, and an armrest assembly mounted to said frame, and* said pivotal joint and said latch assembly being formed for tool-*free detachment of said footrest assembly from said frame when said footrest assembly is in second position and while said armrest assembly remains mounted on said frame by manipulation of said footrest assembly.*

* * * * *